US011508301B2

(12) United States Patent
Dong

(10) Patent No.: US 11,508,301 B2
(45) Date of Patent: Nov. 22, 2022

(54) PIXEL CIRCUIT, DISPLAY SUBSTRATE, DISPLAY PANEL AND PIXEL DRIVING METHOD

(71) Applicant: BOE TECHNOLOGY GROUP CO., LTD., Beijing (CN)

(72) Inventor: Tian Dong, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/427,532

(22) PCT Filed: Jan. 19, 2021

(86) PCT No.: PCT/CN2021/072674

§ 371 (c)(1),
(2) Date: Jul. 30, 2021

(87) PCT Pub. No.: WO2021/143926

PCT Pub. Date: Jul. 22, 2021

(65) Prior Publication Data

US 2022/0101789 A1 Mar. 31, 2022

(30) Foreign Application Priority Data

Jan. 19, 2020 (CN) ..... 202010057869.5

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2310/0272* (2013.01); *G09G 2320/0233* (2013.01)

(58) Field of Classification Search
CPC ..... G09G 3/3233; G09G 3/3291; G09G 2310/0272; G09G 2320/0233
See application file for complete search history.

(56) References Cited

U.S. PATENT DOCUMENTS 8,878,831 B2 11/2014 Tsai et al.
9,697,767 B2 7/2017 Tan et al.
(Continued)

FOREIGN PATENT DOCUMENTS

CN 202855270 U 4/2013
CN 103544917 A 1/2014
(Continued)

*Primary Examiner* — Kenneth B Lee, Jr.
(74) *Attorney, Agent, or Firm* — Houtteman Law LLC

(57) ABSTRACT

An embodiment of the present disclosure provides a pixel circuit, including: a reference writing circuit configured to write a reference voltage to a control electrode of a driving transistor; a data writing circuit configured to write a data voltage to a threshold compensation circuit; the threshold compensation circuit configured to acquire a threshold voltage of the driving transistor, and to supply a first control voltage to the control electrode of the driving transistor and supply a second control voltage to a second electrode of the driving transistor; a reset circuit configured to write a reset voltage to the pixel circuit; and the driving transistor having a first electrode electrically coupled to a first operating voltage terminal and the second electrode electrically coupled to a first electrode of a light emitting element, and configured to drive the light emitting element to emit light.

14 Claims, 4 Drawing Sheets

(56) References Cited

U.S. PATENT DOCUMENTS

| | | | | |
|---|---|---|---|---|
| 9,870,082 | B2 | 1/2018 | Hu | |
| 10,134,329 | B2 | 11/2018 | Han | |
| 2011/0199358 | A1 | 8/2011 | Chung | |
| 2012/0120042 | A1 * | 5/2012 | Tsai ..... | G09G 3/3233 345/76 |

FOREIGN PATENT DOCUMENTS

| | | | |
|---|---|---|---|
| CN | 105118438 | A | 12/2015 |
| CN | 106297662 | A | 1/2017 |
| CN | 111540315 | A | 8/2020 |
| TW | 201220277 | A | 5/2012 |

* cited by examiner

PIXEL CIRCUIT, DISPLAY SUBSTRATE, DISPLAY PANEL AND PIXEL DRIVING METHOD

CROSS-REFERENCE TO RELATED APPLICATIONS

The present application claims the priority of Chinese Patent Application No. 202010057869.5, filed on Jan. 19, 2020, the contents of which are incorporated herein in their entirety by reference.

TECHNICAL FIELD

The present disclosure relates to the field of display technology, and in particular, to a pixel circuit, a display substrate, a display panel, and a pixel driving method.

BACKGROUND

A light emitting element in an Organic Light-emitting Diode (OLED) display device is driven to emit light by a current generated by a driving transistor in a saturation state, but the current process for manufacturing the OLED display device is difficult to ensure uniformity of threshold voltages of driving transistors, and the threshold voltages of the driving transistors may drift to different degrees during usage, so that the OLED display device has a defect of non-uniform brightness of pixels.

In addition, the larger the influence of voltage drop (i.e., IR-Drop) on an operating voltage supplied by an operating power supply is, the easier the defect of non-uniform brightness of the OLED display device is caused.

SUMMARY

In a first aspect, an embodiment of the present disclosure provides a pixel circuit, including: a reference writing circuit, a threshold compensation circuit, a data writing circuit, a reset circuit, and a driving transistor;

where the reference writing circuit is electrically coupled to a reference voltage terminal, a first control signal line, and a control electrode of the driving transistor, and configured to write a reference voltage provided by the reference voltage terminal to the control electrode of the driving transistor in response to a control of the first control signal line;

the data writing circuit is electrically coupled to a data line, the first control signal line and the threshold compensation circuit, and is configured to write a data voltage provided by the data line into the threshold compensation circuit in response to the control of the first control signal line;

the threshold compensation circuit is electrically coupled to a second control signal line, the control electrode of the driving transistor and a second electrode of the driving transistor, and is configured to acquire a threshold voltage of the driving transistor, provide a first control voltage to the control electrode of the driving transistor and a second control voltage to the second electrode of the driving transistor in response to a control of the second control signal line, so as to perform threshold compensation on the driving transistor;

the reset circuit is electrically coupled to a reset voltage terminal and a third control signal line, and is configured to write a reset voltage provided by the reset voltage terminal into the pixel circuit in response to a control of the third control signal line;

a first electrode of the driving transistor is electrically coupled to a first operating voltage terminal, and the second electrode of the driving transistor is electrically coupled to a first electrode of a light emitting element, and the driving transistor is configured to output a corresponding driving current in response to a control of the first control voltage and the second control voltage so as to drive the light emitting element to emit light.

In some implementations, a difference between the first control voltage and the second control voltage is Vdata−Vref+Vth, where Vdata is the data voltage, Vref is the reference voltage, and Vth is the threshold voltage of the driving transistor.

In some implementations, the reference writing circuit includes a first transistor;

a control electrode of the first transistor is electrically coupled to the first control signal line, a first electrode of the first transistor is electrically coupled to the reference voltage terminal, and a second electrode of the first transistor is electrically coupled to the control electrode of the driving transistor.

In some implementations, the data writing circuit includes a second transistor;

a control electrode of the second transistor is electrically coupled to the first control signal line, a first electrode of the second transistor is electrically coupled to the data line, and a second electrode of the second transistor is electrically coupled to the threshold compensation circuit.

In some implementations, the threshold compensation circuit includes a third transistor and a capacitor;

a control electrode of the third transistor is electrically coupled to the second control signal line, a first electrode of the third transistor is electrically coupled to the control electrode of the driving transistor, and a second electrode of the third transistor is electrically coupled to a first electrode of the capacitor and the data writing circuit;

a second electrode of the capacitor is electrically coupled to the second electrode of the driving transistor.

In some implementations, the reset circuit includes a fourth transistor;

a control electrode of the fourth transistor is electrically coupled to the third control signal line, a first electrode of the fourth transistor is electrically coupled to the reset voltage terminal, and a second electrode of the fourth transistor is electrically coupled to the second electrode of the driving transistor.

In some implementations, the reset circuit includes a fourth transistor;

a control electrode of the fourth transistor is electrically coupled to the third control signal line, a first electrode of the fourth transistor is electrically coupled to the reset voltage terminal, and a second electrode of the fourth transistor is electrically coupled to the first electrode of the light emitting element.

In some implementations, the pixel circuit further includes a light emitting control circuit, through which the second electrode of the driving transistor is electrically coupled to the first electrode of the light emitting element;

the light emitting control circuit is electrically coupled to a fourth control signal line, and configured to allow or not allow a current between the second electrode of the driving transistor and the first electrode of the light emitting element in response to a control of the fourth control signal line.

In some implementations, the light emitting control circuit includes a fifth transistor, a control electrode of which is electrically coupled to the fourth control signal line, a first electrode of which is electrically coupled to the second electrode of the driving transistor, and a second electrode of which is electrically coupled to the first electrode of the light emitting element.

In some implementations, the fourth control signal line and the second control signal line are the same control signal line.

In some implementations, the third control signal line and the first control signal line are the same control signal line.

In some implementations, the pixel circuit further includes a light emitting control circuit, through which the second electrode of the driving transistor is electrically coupled to the first electrode of the light emitting element, the light emitting control circuit is electrically coupled to a fourth control signal line and configured to allow or not allow a current between the second electrode of the driving transistor and the first electrode of the light emitting element in response to a control of the fourth control signal line, the reference writing circuit includes a first transistor, the data writing circuit includes a second transistor, the threshold compensation circuit includes a third transistor and a capacitor, the reset circuit includes a fourth transistor, the light emitting control circuit includes a fifth transistor, a control electrode of the first transistor is electrically coupled to the first control signal line, a first electrode of the first transistor is electrically coupled to the reference voltage terminal, a second electrode of the first transistor is electrically coupled to the control electrode of the driving transistor, a control electrode of the second transistor is electrically coupled to the first control signal line, a first electrode of the second transistor is electrically coupled to the data line, a second electrode of the second transistor is electrically coupled to a second electrode of the third transistor and a first electrode of the capacitor, a control electrode of the third transistor is electrically coupled to the second control signal line, a first electrode of the third transistor is electrically coupled to the control electrode of the driving transistor, and the second electrode of the third transistor is electrically coupled to the first electrode of the capacitor and the second electrode of the second transistor;

a control electrode of the fourth transistor is electrically coupled to the third control signal line, a first electrode of the fourth transistor is electrically coupled to the reset voltage terminal, a second electrode of the fourth transistor is electrically coupled to the second electrode of the driving transistor, a control electrode of the fifth transistor is electrically coupled to the fourth control signal line, a first electrode of the fifth transistor is electrically coupled to the second electrode of the driving transistor and the second electrode of the fourth transistor, and a second electrode of the fifth transistor is electrically coupled to the first electrode of the light emitting element, a second electrode of the capacitor is electrically coupled to the second electrode of the driving transistor.

In some implementations, the pixel circuit further includes a light emitting control circuit, through which the second electrode of the driving transistor is electrically coupled to the first electrode of the light emitting element, the light emitting control circuit is electrically coupled to a fourth control signal line and configured to allow or not allow a current between the second electrode of the driving transistor and the first electrode of the light emitting element in response to a control of the fourth control signal line, the reference writing circuit includes a first transistor, the data writing circuit includes a second transistor, the threshold compensation circuit includes a third transistor and a capacitor, the reset circuit includes a fourth transistor, the light emitting control circuit includes a fifth transistor, a control electrode of the first transistor is electrically coupled to the first control signal line, a first electrode of the first transistor is electrically coupled to the reference voltage terminal, and a second electrode of the first transistor is electrically coupled to the control electrode of the driving transistor, a control electrode of the second transistor is electrically coupled to the first control signal line, a first electrode of the second transistor is electrically coupled to the data line, and a second electrode of the second transistor is electrically coupled to a second electrode of the third transistor and a first electrode of the capacitor, a control electrode of the third transistor is electrically coupled to the second control signal line, a first electrode of the third transistor is electrically coupled to the control electrode of the driving transistor, and the second electrode of the third transistor is electrically coupled to the first electrode of the capacitor and the second electrode of the second transistor;

a control electrode of the fourth transistor is electrically coupled to the third control signal line, a first electrode of the fourth transistor is electrically coupled to the reset voltage terminal, and a second electrode of the fourth transistor is electrically coupled to the first electrode of the light emitting element, a control electrode of the fifth transistor is electrically coupled to the fourth control signal line, a first electrode of the fifth transistor is electrically coupled to the second electrode of the driving transistor, and a second electrode of the fifth transistor is electrically coupled to the second electrode of the fourth transistor and the first electrode of the light emitting element, a second electrode of the capacitor is electrically coupled to the second electrode of the driving transistor.

In some implementations, all transistors in the pixel circuit are N-type transistors.

In a second aspect, an embodiment of the present disclosure further provides a display substrate, including: the pixel circuit provided in the first aspect above.

In a third aspect, an embodiment of the present disclosure further provides a display device, including: the display substrate provided in the second aspect above.

In a fourth aspect, an embodiment of the present disclosure further provides a pixel driving method, configured to drive the pixel circuit provided in the first aspect above, where the pixel driving method includes:

in a reset preparation stage, writing the reference voltage to the control electrode of the driving transistor through the reference writing circuit, writing the data voltage to the threshold compensation circuit through the data writing circuit, and writing the reset voltage to the pixel circuit through the reset circuit;

in a threshold compensation stage, writing the reference voltage the control electrode of the driving transistor through the reference writing circuit, writing the data voltage into the threshold compensation circuit through the data writing circuit, and acquiring the threshold voltage of the driving transistor through the threshold compensation circuit;

in a light emitting stage, writing the first control voltage and the second control voltage into the control electrode of the driving transistor and the second electrode of the driving transistor respectively through the threshold compensation circuit, so that the driving transistor outputs a corresponding driving current in response to the control of the first control voltage and the second control voltage to drive the light emitting element to emit light.

In some implementations, the pixel circuit further includes a light emitting control circuit, through which the second electrode of the driving transistor is electrically coupled to the first electrode of the light emitting element, the light emitting control circuit is electrically coupled to a fourth control signal line and configured to allow or not allow a current between the second electrode of the driving transistor and the first electrode of the light emitting element in response to a control of the fourth control signal line, the pixel driving method including:

in the reset preparation stage, providing an effective level voltage signal by the first control signal line, providing turn-off level voltage signals by the second control signal line and the fourth control signal line, and providing an effective level voltage signal by the third control signal line;

in the threshold compensation stage, providing the effective level voltage signal by the first control signal line, providing the turn-off level voltage signals by the second control signal line and the fourth control signal line, and providing a turn-off level voltage signal by the third control signal line;

in the light emitting stage, providing a turn-off level voltage signal by the first control signal line, providing effective level voltage signals by the second control signal line and the fourth control signal line, and providing the turn-off level voltage signal by the third control signal line.

In some implementations, the pixel circuit further includes a light emitting control circuit, through which the second electrode of the driving transistor is electrically coupled to the first electrode of the light emitting element, the light emitting control circuit is electrically coupled to a fourth control signal line and configured to allow or not allow a current between the second electrode of the driving transistor and the first electrode of the light emitting element in response to a control of the fourth control signal line, the pixel driving method including:

in the reset preparation stage, providing effective level voltage signals by the first control signal line and the third control signal line, providing a turn-off level voltage signal by the second control signal line, and providing an effective level voltage signal by the fourth control signal line;

in the threshold compensation stage, providing the effective level voltage signals by the first control signal line and the third control signal line, providing the turn-off level voltage signal by the second control signal line, and providing a turn-off level voltage signal by the fourth control signal line;

in the light emitting stage, providing turn-off level voltage signals by the first control signal line and the third control signal line, providing an effective level voltage signal by the second control signal line, and providing an effective level voltage signal by the fourth control signal line.

DESCRIPTION OF EMBODIMENTS

In order to make those skilled in the art better understand the technical solutions of the present disclosure, the pixel circuit, the display substrate, the display panel and the pixel driving method provided in the present disclosure are described in detail below with reference to the accompanying drawings.

The light emitting element in the embodiments of the present disclosure may be a current-driven light emitting element including an LED (Light Emitting Diode) or an OLED (Organic Light Emitting Diode) in the related art, and the light emitting element is exemplified as the OLED in the embodiments.

The light emitting element has a first electrode and a second electrode, one of which is an anode and the other of which is a cathode. In the embodiments of the present disclosure, the first electrode of the light emitting element is an anode, and the second electrode of the light emitting element is a cathode.

Transistors in the embodiments of the present disclosure may be thin film transistors or field effect transistors or other switching elements having the same characteristics. Each transistor generally includes three electrodes: a gate electrode, a source electrode and a drain electrode, the source electrode and the drain electrode in the transistor are symmetrical in structure, and are interchangeable as required. In the embodiments of the present disclosure, a control electrode of the transistor refers to the gate electrode of the transistor, and one of first and second electrodes of the transistor is the source electrode and the other is the drain electrode.

In the embodiments of the present disclosure, the term "electrically coupled" may be a direct electrical connection or an indirect electrical connection.

Further, transistors may be classified into N-type transistors and P-type transistors according to their characteristics; when the transistor is an N-type transistor, a voltage (also referred to as an effective level voltage) to turn on the transistor is a high level voltage, and a voltage (also referred to as a turn-off level voltage) to turn off the transistor is a low level voltage; when the transistor is a P-type transistor, the voltage (also referred to as an effective level voltage) to turn on the transistor is a low level voltage, and the voltage (also referred to as a turn-off level voltage) to turn off the transistor is a high level voltage.

In the following embodiments, a case where the transistors are all N-type transistors is taken as an example for illustration, which does not limit the technical solutions of the present disclosure.

Figure 1:
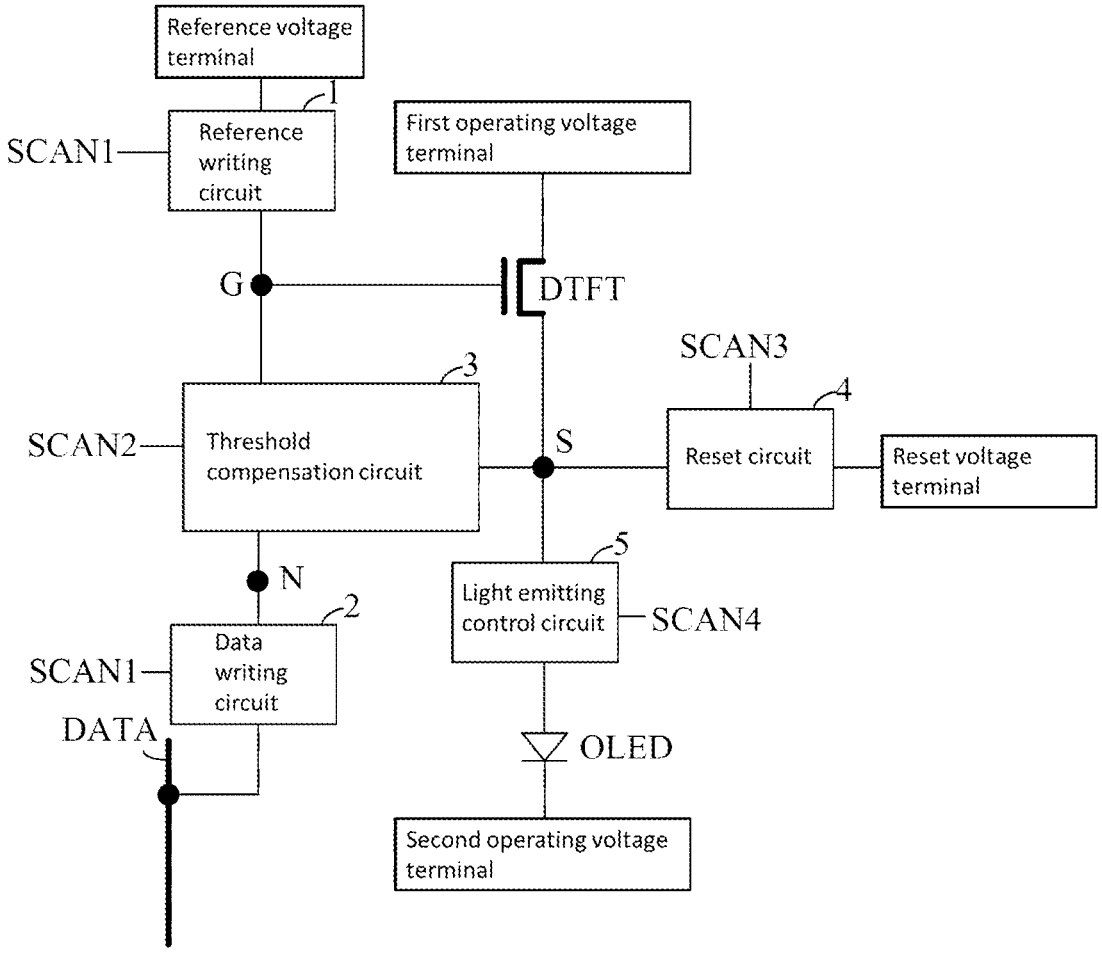
FIG. 1 is a schematic circuit diagram of a pixel circuit according to an embodiment of the present disclosure.

FIG. 1 is a schematic circuit diagram of a pixel circuit according to an embodiment of the present disclosure, and as shown in FIG. 1, the pixel circuit includes: a reference writing circuit 1, a threshold compensation circuit 3, a data writing circuit 2, a reset circuit 4, and a driving transistor DTFT.

The reference writing circuit 1 is electrically coupled to a reference voltage terminal, a first control signal line SCAN1, and a control electrode of the driving transistor DTFT, and the reference writing circuit 1 is configured to write a reference voltage supplied from the reference voltage terminal to the control electrode of the driving transistor DTFT in response to a control of the first control signal line SCAN1.

The data writing circuit 2 is electrically coupled to a data line DATA, the first control signal lines SCAN1, and the threshold compensation circuit 3, and the data writing circuit 2 is configured to write a data voltage supplied by the data line DATA to the threshold compensation circuit 3 in response to the control of the first control signal lines SCAN1.

The threshold compensation circuit 3 is electrically coupled to a second control signal line SCAN2, the control electrode of the driving transistor DTFT, and a second electrode of the driving transistor DTFT, and the threshold compensation circuit 3 is configured to acquire a threshold voltage of the driving transistor DTFT and to supply a first control voltage to the control electrode of the driving transistor DTFT and a second control voltage to the second electrode of the driving transistor DTFT in response to a control of the second control signal line SCAN2, respectively, to perform threshold compensation on the driving transistor.

The reset circuit 4 is electrically coupled to a reset voltage terminal and a third control signal line SCAN3, and is configured to write a reset voltage supplied from the reset voltage terminal to the pixel circuit (e.g., the second electrode of the driving transistor DTFT) in response to a control of the third control signal line SCAN3.

A first electrode of the driving transistor DTFT is electrically coupled to a first operating voltage terminal, the second electrode of the driving transistor DTFT is electrically coupled to a first electrode of the light emitting element OLED, and the driving transistor DTFT is configured to output a corresponding driving current in response to a control of the first control voltage and the second control voltage to drive the light emitting element OLED.

A second electrode of the light emitting element OLED is electrically coupled to a second operating voltage terminal, and the light emitting element OLED is configured to receive the driving current and emit light.

In some implementations, to implement threshold compensation for the driving transistor, a difference between the first control voltage and the second control voltage may be Vdata−Vref+Vth, where Vdata is the data voltage, Vref is the reference voltage, and Vth is the threshold voltage of the driving transistor DTFT; it should be noted that, in the embodiment, the first control voltage and the second control voltage each have a variable voltage level, but the difference between the first control voltage and the second control voltage is fixed to Vdata−Vref+Vth.

The operation of the pixel circuit provided by the embodiment of the present disclosure will be described in detail below. The reference voltage provided by the reference voltage terminal is Vref, the data voltage provided by the data line DATA is Vdata, the reset voltage provided by the reset voltage terminal is Vinit, a first operating voltage provided by the first operating voltage terminal is VDD, and a second operating voltage provided by the second operating voltage terminal is VSS. The operation of the pixel circuit may include a reset preparation stage, a threshold compensation stage and a light emitting stage.

In the reset preparation stage, the reference writing circuit 1 writes the reference voltage into the control electrode of the driving transistor DTFT, the data writing circuit 2 writes the data voltage into the threshold compensation circuit 3, and the reset circuit 4 writes the reset voltage into the pixel circuit (e.g., the second electrode of the driving transistor DTFT). That is, at an end of the reset preparation stage, a voltage at point G is Vref, a voltage at point S is Vinit, and a voltage at point N is Vdata.

In order to ensure a normal operation of the threshold compensation stage, the driving transistor DTFT needs to be turned on at the end of the reset preparation stage, and Vref, Vinit and Vdata should satisfy a following relationship:

$$Vinit<Vref-Vth<VDD.$$

A range of value of the data voltage Vdata is related to Vref, and the larger the Vref is, the larger a minimum value of Vdata is.

In the threshold compensation stage, the reference writing circuit 1 continuously writes the reference voltage to the control electrode of the driving transistor DTFT, the data writing circuit 2 continuously writes the data voltage to the threshold compensation circuit 3, and the threshold compensation circuit 3 acquires the threshold voltage of the driving transistor DTFT.

In the threshold compensation stage, the threshold compensation circuit 3 acquires the threshold voltage of the driving transistor DTFT through a discharge process of the driving transistor DTFT. The specific process will be described in detail later.

In the light emitting stage, the threshold compensation circuit 3 writes the first control voltage and the second control voltage into the control electrode of the driving transistor DTFT and the second electrode of the driving transistor DTFT, respectively, and the driving transistor DTFT outputs a corresponding driving current in response to the control of the first control voltage and the second control voltage to drive the light emitting element OLED to emit light.

In the light emitting stage, the threshold compensation circuit 3 writes the first control voltage and the second control voltage to the control electrode of the driving transistor DTFT and the second electrode of the driving transistor DTFT, respectively, where the difference between the first control voltage and the second control voltage is a voltage signal of Vdata−Vref+Vth. The specific process will be described in detail later.

In the light emitting stage, the difference between the voltage at point G and the voltage at point S is always maintained at Vdata−Vref+Vth, i.e., a gate-source voltage, of the driving transistor DTFT, Vgs=Vdata−Vref+Vth.

In such case, according to a formula of saturation driving current of the driving transistor DTFT, it can be obtained:

$$\begin{aligned} I &= K^*(Vgs - Vth)^2 \\ &= K^*(Vdata - Vref + Vth - Vth)^2 \\ &= K^*(Vdata - Vref)^2, \end{aligned}$$

where I is the driving current output by the driving transistor DTFT, and K is a constant and related to a channel width-to-length ratio and an electron mobility of the driving transistor DTFT.

As can be seen from the above formula, the driving current outputted by the driving transistor DTFT in the light emitting stage is only related to the data voltage Vdata and the reference voltage Vref, and is not related to the threshold voltage of the driving transistor DTFT, the first operating voltage, and the second operating voltage.

The technical solution disclosed by the present disclosure can compensate the threshold voltage of the driving transistor DTFT, so that the driving current is not influenced by the threshold voltage of the driving transistor DTFT, and the defect of non-uniform brightness of pixels caused by non-uniform threshold voltages and drifts of driving transistors DTFT is solved. Meanwhile, the technical solution of the present disclosure can also compensate the operating voltage, so that the driving current is not influenced by the operating voltage, and the defect of non-uniform brightness of overall displaying caused by a voltage drop of the operating voltage is solved.

In addition, since the driving current output by the driving transistor DTFT in the light emitting stage is related to the reference voltage Vref, the light emitting brightness of the light emitting element OLED can be controlled by adjusting a magnitude of the reference voltage Vref. By adjusting the magnitude of the reference voltage Vref, an overall display brightness of a display device can be adjusted.

In some implementations, the pixel circuit may be further provided with a light emitting control circuit 5; where, the second electrode of the driving transistor DTFT may be electrically coupled to the first electrode of the light emitting element OLED through the light emitting control circuit 5; the light emitting control circuit 5 is electrically coupled to a fourth control signal line SCAN4, and is configured to allow or not allow a current between the second electrode of the driving transistor DTFT and the first electrode of the light emitting element OLED in response to a control of the fourth control signal line SCAN4. By allowing or not allowing a current between the second electrode of the driving transistor DTFT and the first electrode of the light emitting element OLED, it is possible to effectively prevent the light emitting element OLED from emitting light by mistake in a non-light emitting stage (i.e., the reset preparation stage and the threshold compensation stage).

It should be noted that, in the embodiment of the present disclosure, the reset circuit 4 may be directly coupled to the second electrode of the driving transistor DTFT, or the reset circuit 4 may be directly coupled to the first electrode of the light emitting element OLED and coupled to the second electrode of the driving transistor DTFT through the light emitting control circuit 5. Both such cases fall within the scope of the present disclosure, and FIG. 1 shows only an example in which the reset circuit 4 is directly coupled to the second electrode of the driving transistor DTFT.

Figure 2:
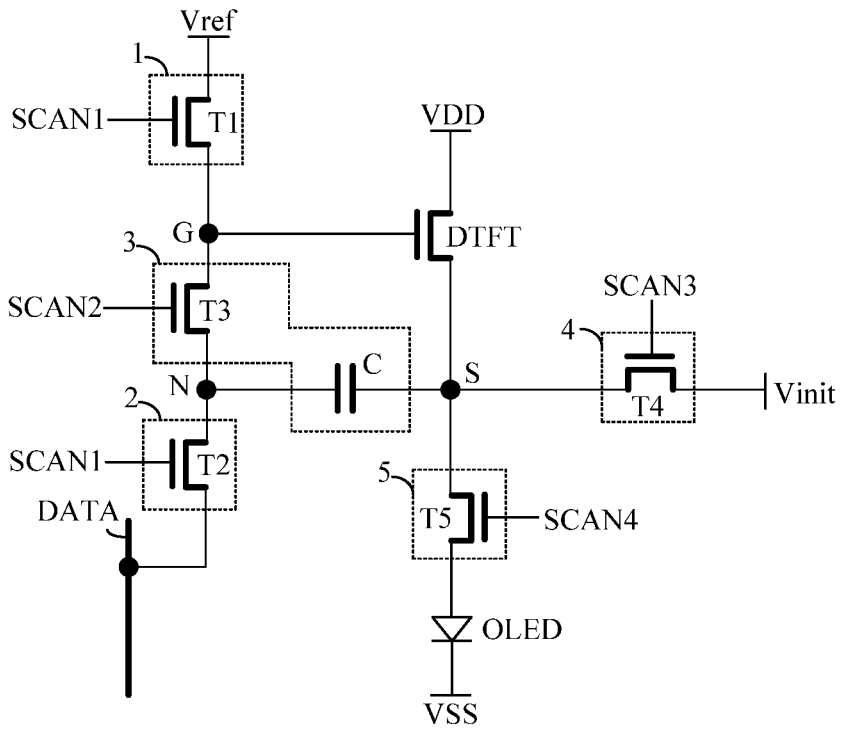
FIG. 2 is another schematic circuit diagram of a pixel circuit according to an embodiment of the present disclosure.

FIG. 2 is another schematic circuit diagram of a pixel circuit according to an embodiment of the present disclosure, and as shown in FIG. 2, the pixel circuit is an alternative implementation based on the pixel circuit shown in FIG. 1.

In some implementations, the reference writing circuit 1 includes: a first transistor T1; a control electrode of the first transistor T1 is electrically coupled to the first control signal line SCAN1, a first electrode of the first transistor T1 is electrically coupled to the reference voltage terminal, and a second electrode of the first transistor T1 is electrically coupled to the control electrode of the driving transistor DTFT.

In some implementations, the data writing circuit 2 includes: a second transistor T2; a control electrode of the second transistor T2 is electrically coupled to the first control signal line SCAN1, a first electrode of the second transistor T2 is electrically coupled to the data line DATA, and a second electrode of the second transistor T2 is electrically coupled to the threshold compensation circuit 3.

In some implementations, the threshold compensation circuit 3 includes: a third transistor T3 and a capacitor C; a control electrode of the third transistor T3 is electrically coupled to the second control signal line SCAN2, a first electrode of the third transistor T3 is electrically coupled to the control electrode of the driving transistor DTFT, and a second electrode of the third transistor T3 is electrically coupled to a first electrode of the capacitor C and the data writing circuit 2; a second electrode of the capacitor C is electrically coupled to the second electrode of the driving transistor DTFT.

In some implementations, the reset circuit 4 includes: a fourth transistor T4; a control electrode of the fourth transistor T4 is electrically coupled to the third control signal line SCAN3, a first electrode of the fourth transistor T4 is electrically coupled to the reset voltage terminal, and a second electrode of the fourth transistor T4 is electrically coupled to the second electrode of the driving transistor DTFT.

In some implementations, the light emitting control circuit 5 includes: a fifth transistor T5; a control electrode of the fifth transistor T5 is electrically coupled to the fourth control signal line SCAN4, a first electrode of the fifth transistor T5 is electrically coupled to the second electrode of the driving transistor DTFT and the reset circuit 4, and a second electrode of the fifth transistor T5 is electrically coupled to the first electrode of the light emitting element OLED.

Further, the fourth control signal line SCAN4 and the second control signal line SCAN2 may be the same control signal line. In such case, types of control signal lines can be effectively reduced, and performance requirements on the control chip can be reduced.

The operation of the pixel circuit shown in FIG. 2 will be described in detail with reference to the accompanying drawings. The first to fifth transistors T1 to T5 are all used as switching transistors.

Figure 3:
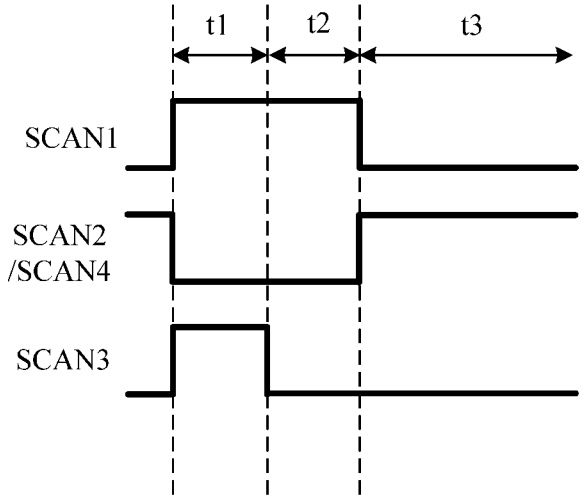
FIG. 3 is a timing diagram illustrating operation of the pixel circuit shown in FIG. 2.

FIG. 3 is a timing diagram illustrating an operation of the pixel circuit shown in FIG. 2, and as shown in FIG. 3, the operation of the pixel circuit may include a reset preparation stage t1, a threshold compensation stage t2 and a light emitting stage t3.

In the reset preparation stage t1, the first control signal line SCAN1 provides a high level voltage signal, the second control signal line SCAN2 and the fourth control signal line SCAN4 provide low level voltage signals, and the third control signal line SCAN3 provides a high level voltage signal. In such case, the first transistor T1, the second transistor T2, and the fourth transistor T4 are turned on, and the third transistor T3 and the fifth transistor T5 are turned off.

The reference voltage Vref is written into point G through the first transistor T1, the data voltage Vdata is written into point N through the second transistor T2, and the reset voltage is written into point S through the fourth transistor T4. In such case, the driving transistor DTFT is turned on.

At an end of the reset preparation stage t1, the voltage at point G is Vref, the voltage at point S is Vinit, and the voltage at point N is Vdata.

In the threshold compensation stage t2, the first control signal line SCAN1 provides a high level voltage signal, the second control signal line SCAN2 and the fourth control signal line SCAN4 provide low level voltage signals, and the third control signal line SCAN3 provides a low level voltage signal. In such case, the first transistor T1, the second transistor T2 are turned on, and the third transistor T3, the fourth transistor T4, and the fifth transistor T5 are turned off.

Since the first transistor T1 and the second transistor T2 are turned on continuously, the voltage at point G is maintained at Vref, and the voltage at N point is maintained at Vdata. Meanwhile, since the fourth transistor T4 is turned off, the driving transistor DTFT outputs a current to charge point S, the voltage at point S increases, and when the voltage at point S is charged to Vref−Vth, the driving transistor DTFT is turned off, that is, the threshold voltage of the driving transistor DTFT is acquired.

It should be noted that, in the process of charging point S by the current output by the driving transistor DTFT, since the fifth transistor T5 is turned off, the current output by the driving transistor DTFT does not flow to the light emitting element OLED, so that the defect of light emitting of the light emitting element OLED by mistake can be avoided.

At an end of the threshold compensation stage t2, the voltage at point G is Vref, the voltage at point S is Vref−Vth, and the voltage at point N is Vdata; a voltage difference across two electrodes of the capacitor C is the voltage at point N minus the voltage at point S, namely Vdata−Vref+Vth.

In the light emitting stage t3, the first control signal line SCAN1 provides a low level voltage signal, the second control signal line SCAN2 and the fourth control signal line SCAN4 provide high level voltage signals, and the third control signal line SCAN3 provides a low level voltage signal. In such case, the third transistor T3 and the fifth transistor T5 are turned on, and the first transistor T1, the second transistor T2 and the fourth transistor T4 are turned off.

Since the fifth transistor T5 is turned on, the voltage at point S is charged to VSS', where VSS' is greater than VSS, and a magnitude of VSS' is related to the second operating voltage VSS, a resistance of the signal line for transmitting the second operating voltage, a voltage difference for turning on the light emitting element OLED, and the like.

Since the first transistor T1 and the second transistor T2 are both turned off, and the third transistor T3 is turned on, voltages at point G and point N are equal to each other, and point G and point N are both in a floating state. In the process of changing the voltage at point S from Vref−Vth to VSS', under bootstrap action of the capacitor C, the voltages at point G and the point N are pulled up to Vdata+VSS'−Vref+Vth. In an entire process of pulling up, although voltages at point G and point S are changed, the voltage difference between the voltage at point G and the voltage at point S is always fixed to be Vdata−Vref+Vth; that is, the threshold compensation circuit 3 supplies the first control voltage to the control electrode of the driving transistor DTFT and the second control voltage to the second electrode of the driving transistor DTFT, and the voltage difference across the control electrode and the second electrode of the driving transistor DTFT is Vdata−Vref+Vth.

Finally, the voltages at points G and N will be stabilized at Vdata+VSS'−Vref+Vth, and the voltage at point S will be stabilized at VSS'.

In the light emitting stage t3, a difference between the voltage at point G voltage and the voltage at point S is always maintained at Vdata−Vref+Vth, i.e., the gate-source voltage, of the driving transistor DTFT, Vgs=Vdata−Vref+Vth.

In such case, according to a formula of saturation driving current of the driving transistor DTFT, it can be obtained:

$$\begin{aligned} I &= K^*(Vgs - Vth)^2 \\ &= K^*(Vdata - Vref + Vth - Vth)^2 \\ &= K^*(Vdata - Vref)^2, \end{aligned}$$

where I is the driving current output by the driving transistor DTFT, and K is a constant and related to a channel width-to-length ratio and an electron mobility of the driving transistor DTFT.

As can be seen from the above formula, the driving current outputted by the driving transistor DTFT in the light emitting stage t3 is only related to the data voltage Vdata and the reference voltage Vref, and is not related to the threshold voltage of the driving transistor DTFT, the first operating voltage, and the second operating voltage.

The technical solution disclosed by the present disclosure can compensate the threshold voltage of the driving transistor, so that the driving current is not influenced by the threshold voltage of the driving transistor, and the defect of non-uniform brightness of pixels caused by non-uniform threshold voltages and drifts of driving transistors is eliminated. Meanwhile, the technical solution of the present disclosure can also compensate the operating voltage, so that the driving current is not influenced by the operating voltage, and the defect of non-uniform brightness of overall displaying caused by a voltage drop of the operating voltage is eliminated.

In addition, since the driving current output by the driving transistor in the light emitting stage t3 is related to the reference voltage Vref, the light emitting brightness of the light emitting element can be controlled by adjusting a magnitude of the reference voltage Vref. By adjusting the magnitude of the reference voltage Vref, an overall display brightness of a display device can be adjusted.

Figure 4:
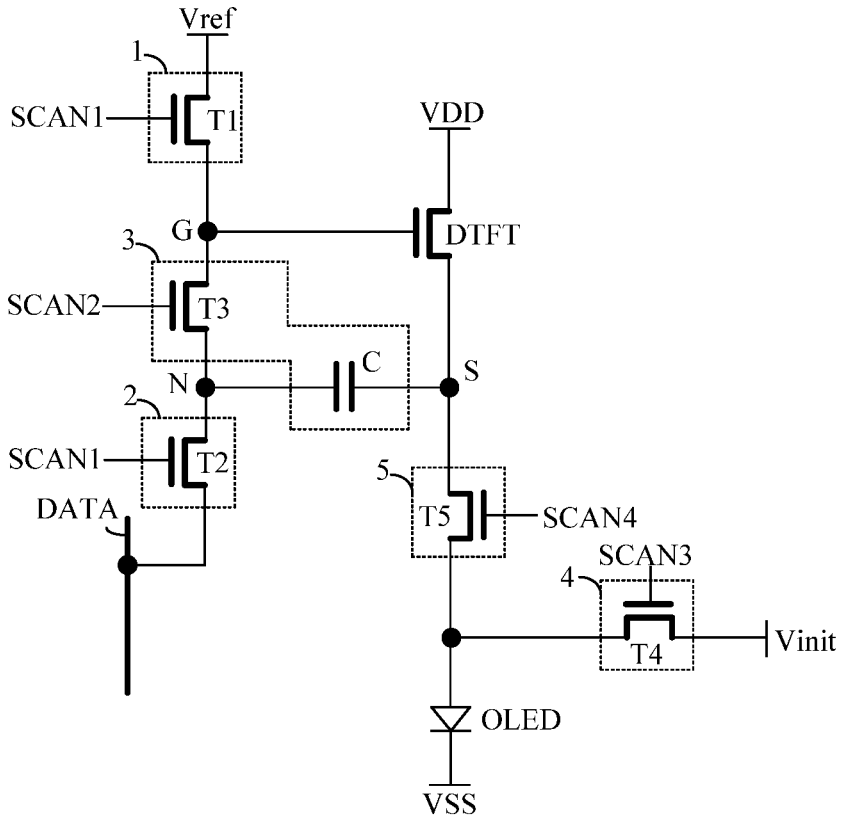
FIG. 4 is a further another schematic circuit diagram of a pixel circuit according to an embodiment of the present disclosure.

FIG. 4 is further another schematic circuit diagram of a pixel circuit according to an embodiment of the present disclosure, and as shown in FIG. 4, unlike the pixel circuit shown in FIG. 2, the reset circuit 4 in the embodiment shown in FIG. 4 is directly coupled to the first electrode of the light emitting element OLED and is coupled to the second electrode of the driving transistor DTFT through the light emitting control circuit 5.

More specifically, the second electrode of the fourth transistor T4 is directly coupled to the second electrode of the fifth transistor T5 and the first electrode of the light emitting element OLED. In such case, the third control signal line SCAN3 and the first control signal line SCAN1 may be the same control signal line.

The operation of the pixel circuit shown in FIG. 4 will be described in detail with reference to the accompanying drawings.

Figure 5:
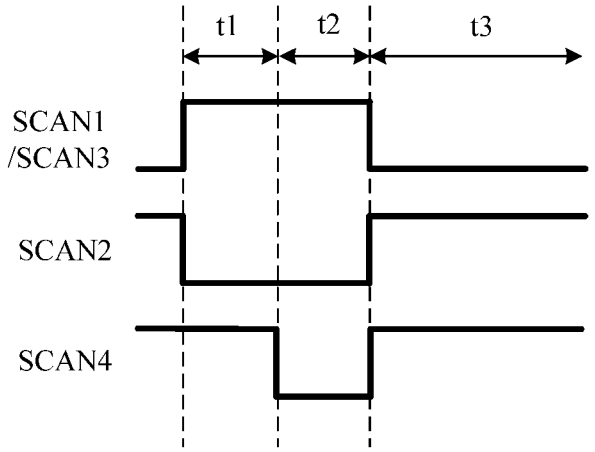
FIG. 5 is a timing diagram illustrating operation of the pixel circuit shown in FIG. 4.

FIG. 5 is a timing diagram illustrating an operation of the pixel circuit shown in FIG. 4, and as shown in FIG. 5, the operation of the pixel circuit may include a reset preparation stage t1, a threshold compensation stage t2 and a light emitting stage t3.

In the reset preparation stage t1, the first control signal line SCAN1 and the third control signal line SCAN3 provide high level voltage signals, the second control signal line SCAN2 provides a low level voltage signal, and the fourth control signal line SCAN4 provides a high level voltage signal. In such case, the first transistor T1, the second transistor T2, the fourth transistor T4, and the fifth transistor T5 are all turned on, and the third transistor T3 is turned off.

The reset voltage is written into the first electrode of the light emitting element OLED through the fourth transistor T4, and the reset voltage is written into the second electrode of the driving transistor DTFT through the fourth transistor T4 and the fifth transistor T5. In the embodiment, the reset process may be performed not only on the second electrode of the driving transistor DTFT but also on the first electrode of the light emitting element OLED, which is beneficial to improve a contrast ratio.

The reference voltage Vref is written into point G through the first transistor T1, the data voltage Vdata is written into point N through the second transistor T2, and the driving transistor DTFT is turned on.

At an end of the reset preparation stage t1, the voltage at point G is Vref, the voltage at point S is Vinit, and the voltage at point N is Vdata.

In the threshold compensation stage t2, the first control signal line SCAN1 and the third control signal line SCAN3 provide high level voltage signals, the second control signal line SCAN2 provides a low level voltage signal, and the fourth control signal line SCAN4 provides a low level voltage signal. In such case, the first transistor T1, the second transistor T2, and the fourth transistor T4 are all turned on, and the third transistor T3 and the fifth transistor T5 are turned off.

Since the first transistor T1 and the second transistor T2 are turned on continuously, the voltage at point G is maintained at Vref, and the voltage at point N is maintained at Vdata. Meanwhile, since the fifth transistor T5 is turned off, the driving transistor DTFT outputs a current to charge point S, the voltage at point S increases, and when the voltage at point S is charged to Vref−Vth, the driving transistor DTFT is turned off, that is, the threshold voltage of the driving transistor DTFT is acquired.

It should be noted that, in the process of charging point S by the current output by the driving transistor DTFT, since the fifth transistor T5 is turned off, the current output by the driving transistor DTFT does not flow to the light emitting element OLED, so that the defect of light emitting of the light emitting element OLED by mistake can be avoided.

At an end of the threshold compensation stage t2, the voltage at point G is Vref, the voltage at point S is Vref−Vth, and the voltage at point N is Vdata; a voltage difference across two electrodes of the capacitor C is the voltage at point N minus the voltage at point S, namely Vdata−Vref+Vth.

In the light emitting stage t3, the first control signal line SCAN1 and the third control signal line SCAN3 provide low level voltage signals, the second control signal line SCAN2 provides a high level voltage signal, and the fourth control signal line SCAN4 provides a high level voltage signal. In such case, the third transistor T3 and the fifth transistor T5 are turned on, and the first transistor T1, the second transistor T2 and the fourth transistor T4 are all turned off.

For a specific process, reference may be made to the foregoing detailed description of the pixel circuit shown in FIG. 2 in the light emitting stage t3, and details are not repeated here.

The technical solution disclosed by the present disclosure can compensate the threshold voltage of the driving transistor, so that the driving current is not influenced by the threshold voltage of the driving transistor, and the defect of non-uniform brightness of pixels caused by non-uniform threshold voltages and drifts of driving transistors is eliminated. Meanwhile, the technical solution of the present disclosure can also compensate the operating voltage, so that the driving current is not influenced by the operating voltage, and the defect of non-uniform brightness of overall displaying caused by a voltage drop of the operating voltage is eliminated.

In addition, since the driving current output by the driving transistor in the light emitting stage t3 is related to the reference voltage, the light emitting brightness of the light emitting element can be controlled by adjusting a magnitude of the reference voltage. By adjusting the magnitude of the reference voltage, an overall display brightness of a display device can be adjusted.

It should be noted that, the case where all the transistors in the pixel circuit in any of the above embodiments are N-type transistors is only an implementation of the present disclosure, and since a hysteresis performance of the N-type transistor is better than that of the P-type transistor, a short-term image retention of the display device can be effectively improved by using the N-type transistor as the driving transistor or the switching transistor. It should be understood by those skilled in the art that after at least one of the transistors in the above embodiments is changed from an N-type transistor to a P-type transistor, the obtained new technical solution also falls into the protection scope of the present disclosure.

Figure 6:
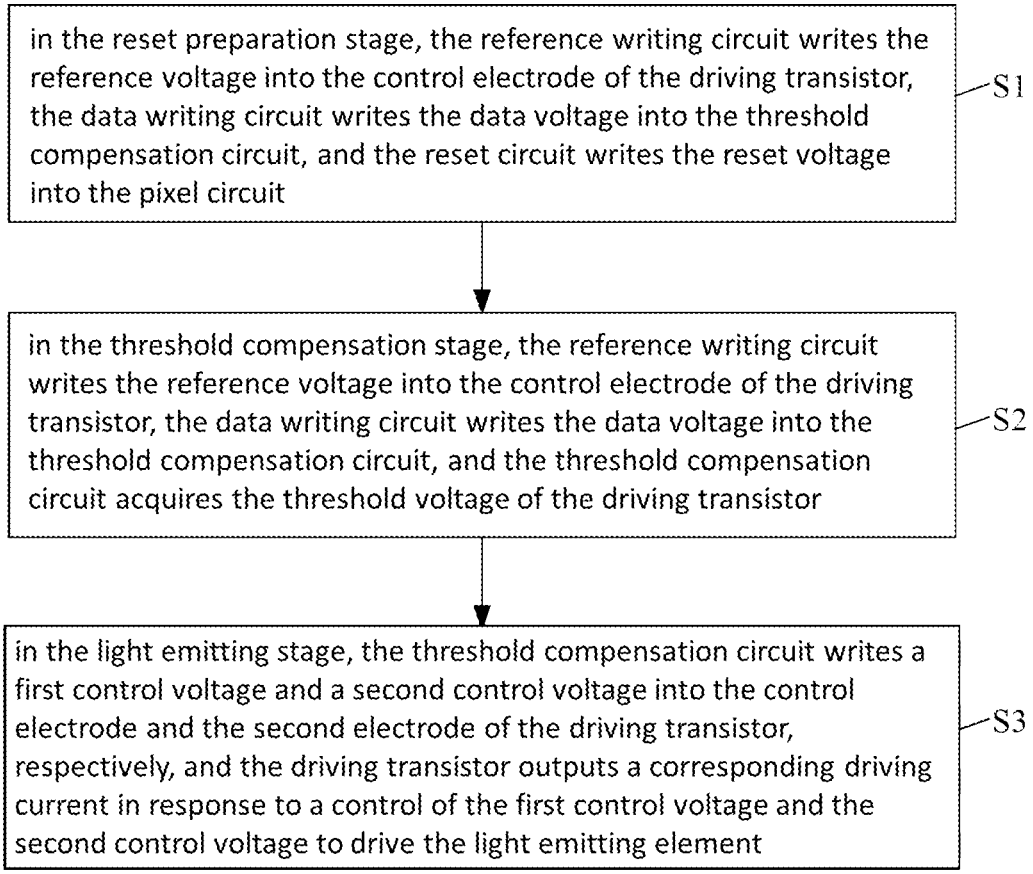
FIG. 6 is a flowchart of a pixel driving method according to an embodiment of the present disclosure.

FIG. 6 is a flowchart of a pixel driving method according to an embodiment of the present disclosure, and as shown in FIG. 6, the pixel driving method is based on the pixel circuit provided in the foregoing embodiments, and for a detailed description of the pixel circuit, reference may be made to corresponding contents in the foregoing embodiments. The pixel driving method includes following steps S1 to S3.

At step S1, in the reset preparation stage, the reference writing circuit writes the reference voltage into the control electrode of the driving transistor, the data writing circuit writes the data voltage into the threshold compensation circuit, and the reset circuit writes the reset voltage into the second electrode of the driving transistor.

At step S2, in the threshold compensation stage, the reference writing circuit writes the reference voltage into the control electrode of the driving transistor, the data writing circuit writes the data voltage into the threshold compensation circuit, and the threshold compensation circuit acquires the threshold voltage of the driving transistor.

At step S3, in the light emitting stage, the threshold compensation circuit writes a first control voltage and a second control voltage into the control electrode of the driving transistor and the second electrode of the driving transistor, respectively, and the driving transistor outputs a corresponding driving current in response to a control of the first control voltage and the second control voltage to drive the light emitting element to emit light.

For specific descriptions of each step, reference may be made to corresponding contents in the foregoing embodiments, which are not described herein again.

The technical solution disclosed by the present disclosure can compensate the threshold voltage of the driving transistor, so that the driving current is not influenced by the threshold voltage of the driving transistor, and the defect of non-uniform brightness of pixels caused by non-uniform threshold voltages and drifts of driving transistors is eliminated. Meanwhile, the technical solution of the present disclosure can also compensate the operating voltage, so that the driving current is not influenced by the operating voltage, and the defect of non-uniform brightness of overall displaying caused by a voltage drop of the operating voltage is eliminated.

In addition, since the driving current output by the driving transistor in the light emitting stage is related to the reference voltage, the light emitting brightness of the light emitting element can be controlled by adjusting a magnitude of the reference voltage. By adjusting the magnitude of the reference voltage, an overall display brightness of a display device can be adjusted.

An embodiment of the present disclosure further provides a display substrate, including the pixel circuit in any one of the above embodiments.

An embodiment of the present disclosure further provides a display device, including the display substrate provided in the above embodiment.

The display device provided by the embodiment of the present disclosure specifically may be any product or component with a display function, such as a display panel, a mobile phone, a tablet computer, a television, a display, a notebook computer, a digital photo frame, a navigator and the like. The display device may further include other essential components understood by those skilled in the art, which are not described herein nor should they be construed as limiting of the present disclosure.

It will be understood that the above embodiments are merely exemplary embodiments employed to illustrate the principles of the present disclosure, are not to be construed as limiting of the present disclosure. It will be apparent to those skilled in the art that various changes and modifications can be made without departing from the spirit and scope of the present disclosure, and these changes and modifications are to be considered within the scope of the present disclosure.

The invention claimed is:

1. A pixel circuit, comprising: a reference writing circuit, a threshold compensation circuit, a data writing circuit, a reset circuit, and a driving transistor; wherein, the reference writing circuit is electrically coupled to a reference voltage terminal, a first control signal line, and a control electrode of the driving transistor, and configured to write a reference voltage provided by the reference voltage terminal to the control electrode of the driving transistor in response to a control of the first control signal line;

the data writing circuit is electrically coupled to a data line, the first control signal line and the threshold compensation circuit, and is configured to write a data voltage provided by the data line into the threshold compensation circuit in response to the control of the first control signal line;

the threshold compensation circuit is electrically coupled to a second control signal line, the control electrode of the driving transistor and a second electrode of the driving transistor, and is configured to acquire a threshold voltage of the driving transistor, and provide a first control voltage to the control electrode of the driving transistor and a second control voltage to the second electrode of the driving transistor in response to a control of the second control signal line, so as to perform threshold compensation on the driving transistor;

the reset circuit is electrically coupled to a reset voltage terminal and a third control signal line, and is configured to write a reset voltage provided by the reset voltage terminal into the pixel circuit in response to a control of the third control signal line;

a first electrode of the driving transistor is electrically coupled to a first operating voltage terminal, the second electrode of the driving transistor is electrically coupled to a first electrode of a light emitting element, and the driving transistor is configured to output a corresponding driving current in response to a control of the first control voltage and the second control voltage so as to drive the light emitting element to emit light, wherein the reset circuit comprises a fourth transistor;

a control electrode of the fourth transistor is electrically coupled to the third control signal line, a first electrode of the fourth transistor is electrically coupled to the reset voltage terminal, and a second electrode of the fourth transistor is directly and electrically coupled to the second electrode of the driving transistor.

2. The pixel circuit of claim 1, wherein a difference between the first control voltage and the second control voltage is Vdata−Vref+Vth, where Vdata is the data voltage, Vref is the reference voltage, and Vth is the threshold voltage of the driving transistor.

3. The pixel circuit of claim 1, wherein the reference writing circuit comprises a first transistor;

a control electrode of the first transistor is electrically coupled to the first control signal line, a first electrode of the first transistor is electrically coupled to the reference voltage terminal, and a second electrode of the first transistor is electrically coupled to the control electrode of the driving transistor.

4. The pixel circuit of claim 1, wherein the data writing circuit comprises a second transistor;

a control electrode of the second transistor is electrically coupled to the first control signal line, a first electrode of the second transistor is electrically coupled to the data line, and a second electrode of the second transistor is electrically coupled to the threshold compensation circuit.

5. The pixel circuit of claim 1, wherein the threshold compensation circuit comprises a third transistor and a capacitor;

a control electrode of the third transistor is electrically coupled to the second control signal line, a first electrode of the third transistor is electrically coupled to the control electrode of the driving transistor, and a second electrode of the third transistor is electrically coupled to a first electrode of the capacitor and the data writing circuit;

a second electrode of the capacitor is electrically coupled to the second electrode of the driving transistor.

6. The pixel circuit of claim 1, further comprising: a light emitting control circuit, through which the second electrode of the driving transistor is electrically coupled to the first electrode of the light emitting element;

the light emitting control circuit is electrically coupled to a fourth control signal line and configured to allow or not allow a current between the second electrode of the driving transistor and the first electrode of the light emitting element in response to a control of the fourth control signal line.

7. The pixel circuit of claim 6, wherein the light emitting control circuit comprises:

a fifth transistor, a control electrode of which is electrically coupled to the fourth control signal line, a first electrode of which is electrically coupled to the second electrode of the driving transistor, and a second electrode of which is electrically coupled to the first electrode of the light emitting element.

8. The pixel circuit of claim 7, wherein the fourth control signal line and the second control signal line are a same control signal line.

9. The pixel circuit of claim 1, further comprising a light emitting control circuit, through which the second electrode of the driving transistor is electrically coupled to the first electrode of the light emitting element, the light emitting control circuit is electrically coupled to a fourth control signal line and configured to allow or not allow a current between the second electrode of the driving transistor and the first electrode of the light emitting element in response to a control of the fourth control signal line, wherein, the reference writing circuit comprises a first transistor, the data writing circuit comprises a second transistor, the threshold compensation circuit comprises a third transistor and a capacitor, the light emitting control circuit comprises a fifth transistor, a control electrode of the first transistor is electrically coupled to the first control signal line, a first electrode of the first transistor is electrically coupled to the reference voltage terminal, and a second electrode of the first transistor is electrically coupled to the control electrode of the driving transistor, a control electrode of the second transistor is electrically coupled to the first control signal line, a first electrode of the second transistor is electrically coupled to the data line, and a second electrode of the second transistor is electrically coupled to a second electrode of the third transistor and a first electrode of the capacitor, a control electrode of the third transistor is electrically coupled to the second control signal line, a first electrode of the third transistor is electrically coupled to the control electrode of the driving transistor, and the second electrode of the third transistor is electrically coupled to the first electrode of the capacitor and the second electrode of the second transistor;

a control electrode of the fifth transistor is electrically coupled to a fourth control signal line, a first electrode of the fifth transistor is electrically coupled to the second electrode of the driving transistor and the second electrode of the fourth transistor, and a second electrode of the fifth transistor is electrically coupled to the first electrode of the light emitting element, a second electrode of the capacitor is electrically coupled to the second electrode of the driving transistor.

10. The pixel circuit of claim 1, wherein all transistors in the pixel circuit are N-type transistors.

11. A display substrate, comprising: the pixel circuit of claim 1.

12. A display device, comprising: the display substrate of claim 11.

13. A pixel driving method for driving the pixel circuit of claim 1, the pixel driving method comprising:

in a reset preparation stage, writing a reference voltage into the control electrode of the driving transistor through the reference writing circuit, writing the data voltage into the threshold compensation circuit through the data writing circuit, and writing the reset voltage into the pixel circuit through the reset circuit;

in a threshold compensation stage, writing the reference voltage into the control electrode of the driving transistor through the reference writing circuit, writing the data voltage into the threshold compensation circuit through the data writing circuit, and acquiring the threshold voltage of the driving transistor through the threshold compensation circuit;

in a light emitting stage, writing the first control voltage and the second control voltage into the control electrode of the driving transistor and the second electrode of the driving transistor respectively through the threshold compensation circuit, so that the driving transistor outputs a corresponding driving current in response to the control of the first control voltage and the second control voltage to drive the light emitting element to emit light.

14. The pixel driving method of claim 13, wherein the pixel circuit further comprises a light emitting control circuit, through which the second electrode of the driving transistor is electrically coupled to the first electrode of the light emitting element, the light emitting control circuit is electrically coupled to a fourth control signal line and configured to allow or not allow a current between the second electrode of the driving transistor and the first electrode of the light emitting element in response to a control of the fourth control signal line, the pixel driving method comprising:

in the reset preparation stage, providing an effective level voltage signal by the first control signal line, providing turn-off level voltage signals by the second control signal line and the fourth control signal line, and providing an effective level voltage signal by the third control signal line;

in the threshold compensation stage, providing the effective level voltage signal by the first control signal line, providing the turn-off level voltage signals by the second control signal line and the fourth control signal line, and providing a turn-off level voltage signal by the third control signal line;

in the light emitting stage, providing a turn-off level voltage signal by the first control signal line, providing effective level voltage signals by the second control signal line and the fourth control signal line, and providing the turn-off level voltage signal by the third control signal line.

* * * * *